US005582337A

United States Patent [19]

McPherson et al.

[11] Patent Number: 5,582,337

[45] Date of Patent: Dec. 10, 1996

[54] STRAP SYSTEM FOR CARRYING SKATES AND SHOES AND METHOD OF USE

[76] Inventors: Mathew A. McPherson, P.O. Box 633; Wade R. Wilson, 805 4th Ave. Southwest, both of Austin, Minn. 55912

[21] Appl. No.: 492,538

[22] Filed: Jun. 20, 1995

[51] Int. Cl.[6] ..... A45C 13/30

[52] U.S. Cl. ..... 224/660; 224/665; 224/663; 24/306

[58] Field of Search ..... 224/205, 202, 224/203, 257, 258, 250, 917, 224, 255, 214, 660–665; 24/306

[56] References Cited

U.S. PATENT DOCUMENTS 3,401,857 9/1968 Wilson et al. ..... 224/214
5,110,023 5/1992 Colin ..... 224/205
5,246,154 9/1993 Adams ..... 224/257
5,425,485 6/1995 Carlo ..... 224/205

*Primary Examiner*—David J. Walczak
*Attorney, Agent, or Firm*—Vidas, Arrett & Steinkraus, PA

[57] ABSTRACT

A strap system for carrying shoes when a skater is skating and skates when the skater is walking. The strap system comprises a first strap, having a first end and a second end and a first connecting mechanism for connecting the first and second ends of the first strap, which when connected create a first closed loop. A second strap is attached to the first strap by an attachment mechanism, the second strap comprising a first end and a second end and a second connecting mechanism for connecting the first and second ends of the second strap, which when connected create a second loop. The strap system is utilized wherein during use of the strap system, the first loop is situated around the user's waist or slung over the user's shoulder and the second loop secures the foot apparel.

25 Claims, 1 Drawing Sheet

STRAP SYSTEM FOR CARRYING SKATES AND SHOES AND METHOD OF USE

BACKGROUND OF THE INVENTION

This invention relates to a skate or shoe carrying strap system. More particularly, a strap system used to carry skates while walking and shoes while skating.

In-line skating has become very popular in recent years. In-line skating offers highly economical entertainment and exercise because of its vercitility and the fact that it may be done at numerous locations which provide a hard surface. In-line skates, such as those made by RollarBlade™, are quite bulky and moderately heavy. It can be awkward for skaters to carry their skates to a location where they may skate. Once the skater has put the skates on he must find someplace for his shoes that were taken off. The skater either has to leave the shoes behind or carry them along. Skaters who wish to stop or rest at a location must carry their shoes if they want to walk around or do something in which shoes are required. Similar problems arise for ice skaters.

There is a need for a light, easy and inexpensive way to carrying skates when a skater is walking and to carry shoes, or other like foot apparel, when the skater is skating. The present invention is directed at providing for this need.

SUMMARY OF THE INVENTION

The present invention is directed to a strap system for carrying skates while a skater is walking and for carrying shoes when the skater is skating. The strap system comprises a first strap, having a first end and a second end and a first connecting means for connecting the first and second ends of the first strap, which when connected create a first closed loop. A second strap is attached to the first strap by an attachment means, the second strap comprising a first end and a second end and a second connecting means for connecting the first and second ends of the second strap, which when connected create a second loop. The strap system is utilized by wrapping the first loop around the user's waist or slinging the first loop over the user's shoulder and securing the second loop to the skates or shoes.

Other objects, features, and characteristics of the present invention, as well as the methods of operation and functions of the related elements of the structure, and the combination of parts and economics of manufacture, will become more apparent upon consideration of the following description with reference to the accompanying drawings, all of which form a part of this specification.

DETAILED DESCRIPTION OF THE INVENTION

Figure 1:
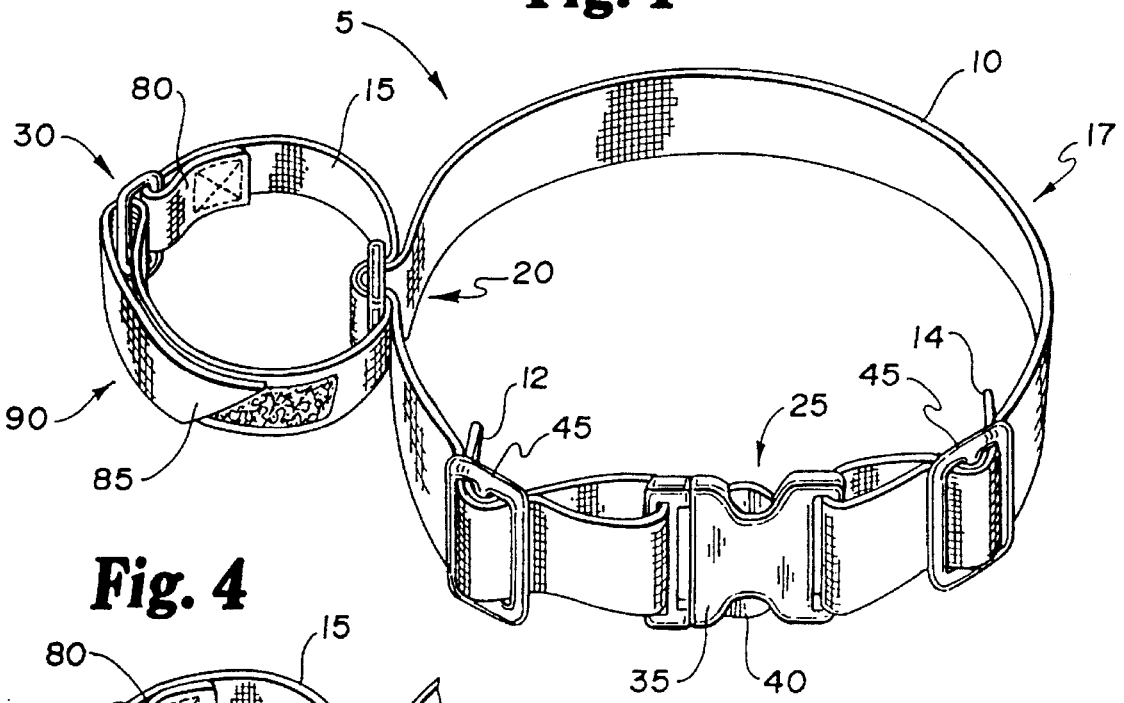
FIG. 1 is a side elevational view of the invention.

In FIG. 1 illustrates the strap system, generally designated 5. The strap system generally comprises a first strap, generally designated 10, and a second strap, generally designated 15, wherein the second strap 15 is connected to the first strap 10 by an attachment means, generally designated 20. The first strap 10 includes a first connecting means, generally designated 25, and the second strap includes a second connecting means, generally designated 30, wherein the first 10 and second 15 straps may be closed by means of the first 25 and second 30 connecting means, respectively, forming two closed loops. The loop created by the second strap 15, generally designated 90, functions to secure and carry the skates or shoes and the loop creating by the first strap 10, generally designated 17, is wrapped around the users waist or slung over the users shoulder. Preferably, when the skater is walking the second strap is secured to the blades of the skates and the first strap is connected and slung over the user's shoulder. When the skater is skating loop 90 is wrapped around the skater's shoes and the first strap 10 is wrapped around the user's waist.

Figure 2:
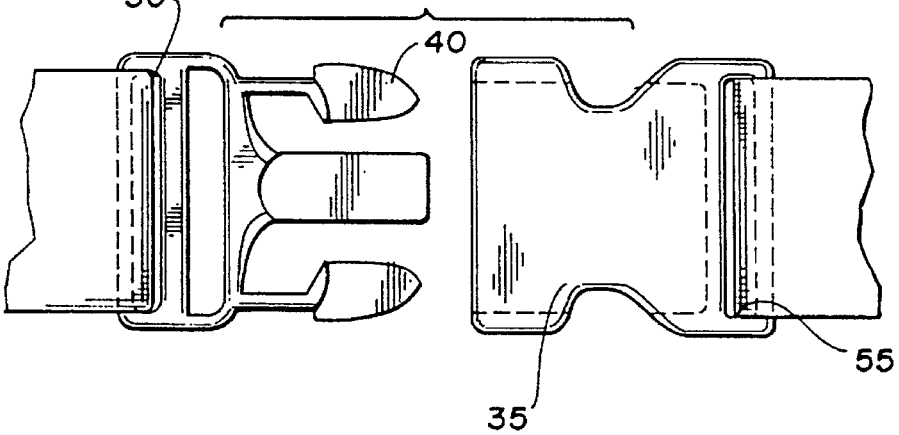
FIG. 2 is a top plan view of the fixed buckle of the invention.

The first strap 10, as seen in FIG. 1, may be made of any flexible material, but is preferable light weight and made of nylon. In the preferred embodiment, connection means 25 comprises a fixed buckle. The fixed buckle, best shown in FIG. 2, preferable comprises a female portion 35 and a male portion 40, both portions being connected to either ends, first end 12 and second end 14, of the first strap 10. The male 40 and female 35 portions both comprise attachment portions 50 and 55, respectively, wherein the ends 12 and 14 of the first strap 10 are connected to attachment portions 50 and 55, respectively. When the male portion 40 engages the female portion 35 loop 17 is closed. The loop 17 created by the first strap 10 is either worn in belt fashion or slung over the shoulder of the user.

Figure 3A:
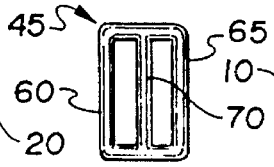
FIG. 3*a* is a top plan view of the sliding buckle of the invention.
Figure 3B:
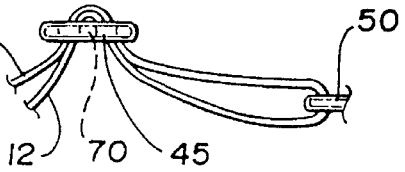
FIG. 3*b* is a side view of the sliding buckle install on the invention.

In the preferred embodiment, the first strap further comprises at least one, most preferably two, sliding buckles, generally designated 45, used to adjust the length of the first strap. Sliding buckles are well known and quite commonly used in the size adjustment of apparel and accessories, the size and configuration of which may be highly varied. The preferable configuration is best seen in FIG. 3*a* and FIG. 3*b*, which illustrates the function thereof. Preferably, the sliding buckle 45 is generally rectangular with a first and second side, 60 and 65, and a center bar 70. FIG. 3*b* illustrates the method in which the sliding buckles 45 function. In this particular embodiment, first end 12 of the first strap 10 is taken up through the gap between first side 60 and center bar 70 and then down through the gap between second side 65 and center bar 70. First end 12 is then taken through the gap defined by either attachment portion, 50 or 55, (attachment portion 50 shown in FIG. 3*b*) and back up through the gap between second side 65 and center bar 70 and finally down through the gap between first side 60 and center bar 70. When the first strap is pulled tight within the sliding buckle 45 the sliding buckle 45 resists slippage. The sliding may be adjusted by loosening the strap. Preferably, the ends of first strap 10 are hemmed to further prevent first strap 10 from slipping out of the sliding buckles 45. The sliding buckles 45 allow the user to adjust the size of the loop 17 created by the first strap 10. The sliding buckles mentioned are meant only to be illustrative of a preferred embodiment and are not meant to be exclusive.

Figure 4:
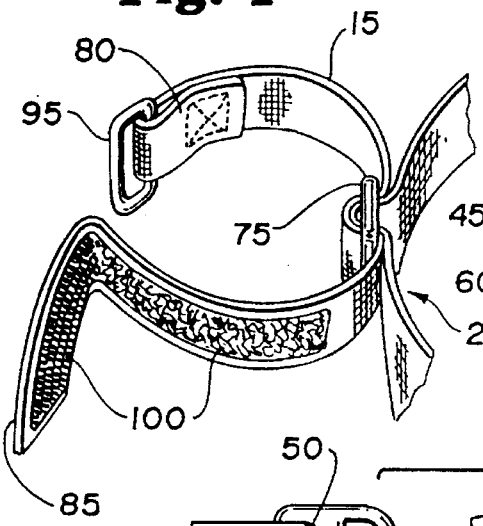
FIG. 4 is a side elevational view of the second strap of the invention.

The second strap, as seen in FIG. 1, has a first end 80 and a second end 85 and is attached to the first strap by attachment means 20, which may be located anywhere along the first strap 20. Attachment means 20 may comprise any means to accomplish the function, such as stitching, gluing or buckling and may be both fixed or slidable. Preferably, the attachment means 20 is slidable and comprises a third sliding buckle 75, which functions in the same fashion as the sliding buckles 45 as described above. The second connecting means 30, which connects first end 80 and second end 85 to form second loop 90, may comprise any means of connecting ends 80 and 85, such as a buckle, snaps, clips, etc., but preferably is adjustable and comprises a ring 95, most preferably a "D" ring, attached to first end 80, as seen in FIG. 4, and a VELCRO™ (hook and loop fastener) strip on second end 85, whereby the connection between ends 80 and 85 is facilitated by feeding end 85 through ring 95 and folding end 85 back over itself to engage the VELCRO™ (hook and loop fastener).

The D-ring/VELCRO™ (hook and loop fastener) strip combination on the second strap provides superior leverage when cinching down the object which the user is carrying. By feeding the second end through the D-ring and pulling back on the second end, the user achieves approximately a 2:1 leveraging action. After the second strap is tighten to securely grip the object carried, the second end is folded back over itself to lock the carried object into place by engaging the VELCRO™ (hook and loop fastener) strip. Since most objects do not have an aperture through which to feed the second strap, similar to the method of carrying skates which have an aperture between the blades and the soles of the skate, it is important to be able to easily tighten the second strap to hold the carried object firmly so that it does not slip out of the loop created by the second strap during travel.

The strap system is preferably made of light weight and flexible material such as nylon, but may be fabricated from any flexible material of the users choosing. The buckles are preferably made of a rigid material such as aluminum, metal or plastic, most preferable plastic. The first end 80 of the second strap 15 may be attached to the second connecting means 30, i.e., a D-ring, using such methods as stiching, stapling or gluing.

The preferred method of using the strap system 5 is as follows. To carry either ice skates or in-line skates end 85 of the second strap 15 is fed through the gap between the blades of the skates and the sole of the skates and then connected to end 80, preferable by feeding end 85 through ring 95 and then end 85 is folded back over itself to engage the VELCRO™ (hook and loop fastener) strip. The first connecting means 25, preferably being a fixed buckle, is connected thus creating a loop 17. Loop 17 is then slung over the skater's shoulder. When the skater is prepared to skate, the skater removes the skates from the second strap 15 and unfastens the first connecting means 25. The skater then wraps strap 15 around his removed shoes and connects end 85 to end 80, as described above, to snugly contain the shoes. The skater then wraps the strap 10 around his waist, adjusting the strap 10 by means of the sliding buckles 45 to the size of the skater's waist and engages first connecting means 25. Preferably, attachment means 20 is slid along the first strap 10 so that it is positioned at the back of the skater. The skater is then prepared to skate with his shoes carried by the strap system 5 without being encumbered and leaving his hands free to aid in balancing.

It should also be understood that the strap system may be used in other applications functioning to carry other objects. The manner in which the other items would be carried is the same as that disclosed above, whether the user wishes to carry the item by slinging the first strap over the user's shoulder or by wrapping the first strap around the user's waist. Other objects may include jackets or other types of clothing, a carrying pouch, wallets or money belts and insulated containers to store beverages or food.

The above disclosure is intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. A strap system for carrying foot apparel, comprising:

a first strap, having a first end and a second end;

a first connecting means for connecting the first and second ends of the first strap, which when connected create a first closed loop defining a first plane;

a second strap having a first end and a second end, wherein the second strap is attached to the first strap by an attachment means, the attachment means being slidable along the first strap; and a second connecting means for connecting the first and second ends of the second strap, which when connected create a second loop defining a second plane wherein said first and second planes are coplanar;

wherein during use of the strap system, the first loop is adapted to be situated around a user's waist or slung over the user's shoulder and the second loop is adapted to secure the foot apparel.

2. The strap system as in claim 1, wherein the second connecting means is adjustable so that the size of the second loop may be adjusted for proper securement of the foot apparel.

3. The strap system as in claim 2, the first strap further comprising an adjusting means, wherein the size of the first loop may be adjusted for properly fitting the waist of the user.

4. The strap system as in claim 3, the first connecting means further comprising a fixed buckle having a female portion connected to the first end of the first strap and a male portion connected to the second end of the first strap, wherein the male portion is engagable to the female portion.

5. The strap system as in claim 4, wherein the attachment means is slidably attached to the first strap.

6. The strap system as in claim 5, wherein the adjusting means comprises at least one sliding buckle.

7. The strap system as in claim 6, wherein the second connecting means comprises a ring attached to the first end of the second strap and a hook and loop fastener strip positioned on the second end of the second strap, wherein facilitation of the connection is achieved by sliding the second end of the second strap through the ring and folding the second end of the second strap back over itself to engage the hook and loop fastener strip.

8. A strap system for carrying foot apparel, comprising;

a first strap, having a first end and a second end;

a first connecting means for connecting the first and second ends of the first strap, which when connected create a first closed loop defining a first plane the first connecting means further comprising a fixed buckle having a female portion connected to the first end of the first strap and a male portion connected to the second end of the first strap, wherein the male portion is engagable to the female portion, the first strap still further comprising an adjusting means, wherein the adjusting means comprises at least one sliding buckle whereby the size of the first loop may be adjusted for properly fitting the waist of a user;

a second strap having a first end and a second end, wherein the second strap is attached to the first strap by an attachment means, wherein the attachment means being slidably attached to the first strap; and a second connecting means for connecting the first and second ends of the second strap, which when connected create a second loop defining a second plane wherein said first and second plane are coplanar, wherein the second connecting means is adjustable so that the size of the second loop may be adjusted for proper securement of the foot apparel and wherein the second connecting means further comprises a ring attached to the first end of the second strap and a hook and loop fastener strip positioned on the second end of the second strap, wherein facilitation of the connection is achieved by sliding the second end of the second strap through the ring and folding the second end of the second strap back over itself to engage the hook and loop fastener strip, wherein during use of the strap system, the first loop is adapted to be situated around the user's waist or slung over the user's shoulder and the second loop is adapted to secure the foot apparel.

9. The strap system as in claim 8, wherein the adjusting means comprises two sliding buckles.

10. The strap system as in claim 9, wherein the first and second straps are made of nylon.

11. A method of using a strap system for carrying foot apparel, the foot apparel including skates having blades attached to soles and shoes and wherein the strap system comprises:

a first strap, having a first end and a second end;

a first connecting means for connecting the first and second ends of the first strap, which when connected create a first closed loop;

a second strap having a first end and a second end, wherein the second strap is attached to the first strap by an attachment means; and a second connecting means for connecting the first and second ends of the second strap, which when connected create a second loop;

the method comprising the steps of:

feeding the second end of the second strap through a gap between the blades and the sole of the skates;

securing the first and second ends of the second strap to each other by the second connecting means;

securing the first and second ends of the first strap to each other by the first connecting means; and slinging the first loop over a user's shoulder.

12. The method of using a strap system for carrying foot apparel as in claim 11, further comprising the steps of:

disengaging the first and second connecting means and removing the skates;

wrapping the second strap around the shoes;

securing the first and second ends of the second strap to each other by the second connecting means to snugly contain the shoes; and wrapping the first strap around the user's waist and securing the first and second ends of the first strap to each other by the first connecting means.

13. The method of using a strap system for carrying foot apparel as in claim 12, wherein the second connecting means is adjustable so that the size of the second loop may be adjusted to properly secure the foot apparel.

14. The method of using a strap system for carrying foot apparel as in claim 13, the first strap further comprising an adjusting means, wherein the size of the first loop may be adjusted to properly fit the waist of the user.

15. The method of using a strap system for carrying foot apparel as in claim 14, the first connecting means further comprising a fixed buckle having a female portion connected to the first end of the first strap and a male portion connected to the second end of the first strap, wherein the male portion is engagable to the female portion.

16. The method of using a strap system for carrying foot apparel as in claim 15, wherein the attachment means is slidably attached to the first strap.

17. The method of using a strap system for carrying foot apparel as in claim 16, wherein the adjusting means comprises at least one sliding buckle.

18. The method of using a strap system for carrying foot apparel as in claim 17, wherein the second connecting means comprises a ring attached to the first end of the second strap and a hook and loop fastener strip positioned on the second end of the second strap, wherein facilitation of the connection is achieved by sliding the second end of the second strap through the ring and folding the second end of the second strap back over itself to engage the hook and loop fastener strip.

19. The method of using a strap system for carrying foot apparel as in claim 18, the sliding buckle being slidable along the second strap.

20. The method of using a strap system for carrying foot apparel as in claim 19, the adjusting means comprising two sliding buckles.

21. The method of using a strap system for carrying foot apparel as in claim 20, wherein the first and second straps are made of nylon.

22. A method of using a strap system for carrying shoes while a skater is skating, wherein the strap system comprises:

a first strap, having a first end and a second end;

a first connecting means for connecting the first and second ends of the first strap, which when connected create a first closed loop;

a second strap having a first end and a second end, wherein the second strap is attached to the first strap by an attachment means; and a second connecting means for connecting the first and second ends of the second strap, which when connected create a second loop;

the method comprising the steps of:

wrapping the second strap around the shoes;

securing the first and second ends of the second strap to each other by the second connecting means to snugly contain the shoes; and wrapping the first strap around the skater's waist and securing the first and second ends of the first strap to each other by the first connecting means.

23. A method of using a strap system for carrying an item, wherein the strap system comprises:

a first strap, having a first end and a second end;

a first connecting means for connecting the first and second ends of the first strap, which when connected create a first closed loop defining a first plane;

a second strap having a first end and a second end, wherein the second strap is attached to the first strap by an attachment means, the attachment means being slidable along the first strap; and a second connecting means for connecting the first and second ends of the second strap, which when connected create a second loop defining a second plane wherein said first and second planes are coplanar; the method comprising the steps of:

wrapping the second strap around the item;

securing the first and second ends of the second strap to each other by the second connecting means to snugly contain the item; and wrapping the first strap around a user's waist and securing the first and second ends of the first strap to each other by the first connecting means.

24. The method of using a strap system for carrying an item as in claim 23, wherein the second connecting means comprises a ring attached to the first end of the second strap and a hook and loop fastener strip positioned on the second end of the second strap, wherein facilitation of the connection is achieved by sliding the second end of the second strap through the ring and folding the second end of the second strap back over itself to engage the hook and loop fastener strip.

25. A strap system for carrying objects, comprising:

a first strap, having a first end and a second end;

a first connecting means for connecting the first and second ends of the first strap, which when connected create a first closed loop defining a first plane, the first strap further comprising an adjusting means to adjust the size of the first loop to properly fit the waist of a user, wherein the adjusting means comprises at least one sliding buckle, the sliding buckle being slidable along the first strap;

a second strap having a first end and a second end, wherein the second strap is attached to the first strap by an attachment means; and a second connecting means for connecting the first and second ends of the second strap, which when connected create a second loop defining a second plane wherein said first and second plane are coplanar, wherein during use of the strap system, the first loop is situate around the user's waist or slung over the user's shoulder and the second loop secures the object.

* * * * *